United States Patent [19]

Epstein et al.

[11] Patent Number: 4,951,969

[45] Date of Patent: Aug. 28, 1990

[54] APPARATUS AND METHOD FOR THE POSITIVE AND CONVENIENT CORRELATION OF THE IDENTITY OF THE DONOR OF A GIFT WITH THE GIFT

[75] Inventors: Jack Epstein, 155 E. 31st St., Apt. 28J, New York, N.Y. 10016; Morris Epstein, Kings Point; Charles W. Socarides, New York, both of N.Y.

[73] Assignee: Jack Epstein, New York, N.Y.

[21] Appl. No.: 390,077

[22] Filed: Aug. 7, 1989

[51] Int. Cl.[5] ..... B42D 15/00

[52] U.S. Cl. ..... 283/67; 283/81; 283/101; 40/124.1; 40/299

[58] Field of Search ..... 283/70, 67, 69, 74, 283/81, 100, 101, 80; 281/5, 51; 40/124.1, 299, 638, 360

[56] References Cited

U.S. PATENT DOCUMENTS

| | | | |
|---|---|---|---|
| 3,226,862 | 1/1966 | Gabruk | 283/101 |
| 4,042,171 | 8/1977 | Ross et al. | 283/80 |
| 4,439,941 | 4/1984 | Halperin | 40/124.1 |

*Primary Examiner*—Paul A. Bell
*Assistant Examiner*—Hwei-Siu Payer

[57] ABSTRACT

An improved greeting card for use with the giving of a gift and method of using a greeting card in the giving of a gift is disclosed. A special card is provided with a removable label which aids a gift recipient in the positive and convenient identification of the donor of a gift and of the gift itself.

16 Claims, 3 Drawing Sheets

FIG. 3
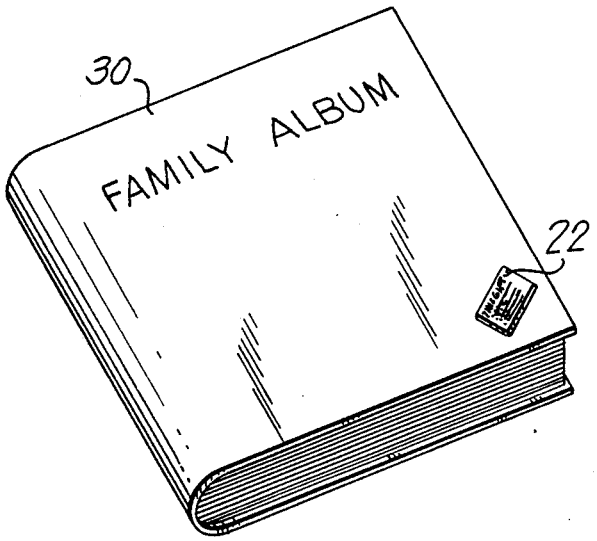
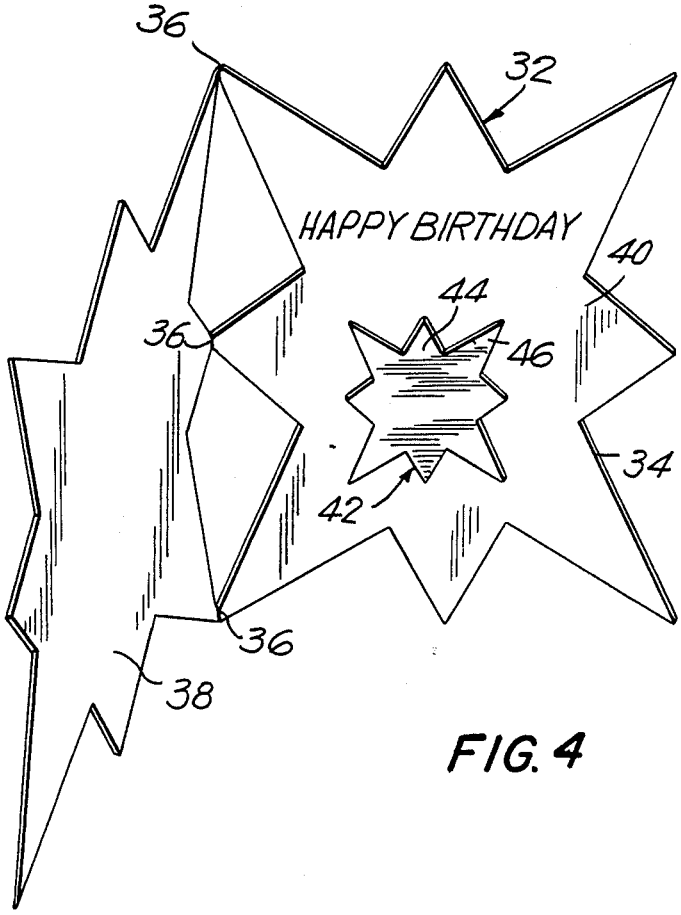
FIG. 4

APPARATUS AND METHOD FOR THE POSITIVE AND CONVENIENT CORRELATION OF THE IDENTITY OF THE DONOR OF A GIFT WITH THE GIFT

BACKGROUND OF THE INVENTION

1. Field of The Invention

This invention relates to new and improved apparatus and method for the positive and convenient correlation by the recipient of a gift of the identity of the donor of the gift with the gift.

2. Description of the Prior Art

Although the use of re-usable adhesive-backed labels or the like for a wide variety of purposes is, of course well known, no prior art is known which discloses or makes obvious the use of the same on a gift card in conjunction with the donation of a gift from a gift donor to a gift recipient to positively and conveniently correlate to the gift recipient the identity of the donor of the gift with the gift.

More specifically, although each of U.S. Pat. No. 4,215,879 to Blum and U.S. Pat. No. 4,235,459 to Callahan show the attachment of specially shaped labels to objects, and maintaining a register to identify the same in accordance with the labels, in Blum for medical laboratory samples and in Callahan for keys neither of these disclosures has any relevance or application to the use of such labels in conjunction with a gift card for the purposes disclosed herein.

U.S. Pat. No. 2,363,472 to Ritter and U.S. Pat. No. 4,200,222 to Feuer respectively disclose mailing and greeting cards including decals which may be readily removed therefrom for application to other surfaces for decorative use as such, neither of these disclosures has any relevance or application to the use of these decals in conjunction with a gift card for the purposes disclosed herein.

U.S. Pat. No. 4,008,852 discloses a mailing card having an adhesive-backed section and an apertured section in alignment therewith for the attachment and display of a photograph with the card, and thus has no relevance or application to the correlation of the identity of the donor of a gift with the gift through use of a gift card.

U.S. Pat. No. 922,948 Portmore, U.S. Pat. No. 1,750,192 to Pendergast, U.S. Pat. No. 2,096,153 to Weiss and U.S. Pat. No. 3,228,129 to Gwinn respectively disclosed specially marked baggage or garment tags or the like which although useful for the identification of the same, have no relevance or application tothe use of the tags in conjunction with a gift card for the purposes disclosed herein.

U.S. Pat. No. 4,051,996 to Ross et al discloses a travel envelope having integrally formed baggage identification labels which are in no way applicable or relevant to the correlation of the identity of the donor of a gift with the gift.

U.S. Pat. No. 4,484,768 discloses a greeting card comprising a readily removable cover member which operates in conjunction with a card face to actuate a card-contained odor means, and which is simply discarded after removal from the card to those purposes; it being clear that the cover member would have absolutely no relevance or application to gift donor identification in conjunction with a gift card.

U.S. Pat. No. 2,805,816 to Morgan discloses a mailing piece comprising pressure-sensitive adhesive labels or the like bearing identification and telephone number information for removal from the mailing piece for re-use in a memo pad or the like; while U.S. Pat. No. 4,706,877 to Jenkins discloses a mailer comrpising an adhesive-backed return address label for removal therefrom and application to a return envelope; it being clear, however, that neither of the Morgan or Jenkins labels have any relevance or application to the purposes here at hand.

U.S. Pat. No. 892,675 to Morrison discloses a gummed address label which is detachably secured to a letter sheet for removal therefrom and use as the address on a provided return envelope; while U.S. Pat. No. 2,336,867 to Huber discloses a price band which functions to retain a greeting card and matching envelope together for display and sale, and which is simply discarded after such sale; it being clear that neither the Morrison gummed address label or Huber's price band have any relevance or application to use in conjunction with a gift card to positively correlate the identity of a gift donor with the gift.

OBJECTS OF THE INVENTION

It is, accordingly, an object of my invention to provide new and improved apparatus and method for use in conjunction with a gift card to provide positive and convenient correlation to the recipient of gift between the identity of the gift donor and the gift.

It is another object of my invention to provide apparatus and method as above which are extremely easy to use.

It is another object of my invention to provide apparatus and method as above which can operate to provide a virtually fool-proof reminder to the recipient of a gift of the sociàl obligation to acknowledge the same with an appropriate message of thanks.

It is another object of my invention to provide apparatus and method as above which can also operate to provide to the recipient of a gift information in the nature of the postal address, telephone number and FAX address of the gift donor in addition to correlation between the donor's identity and the gift.

It is a further object of my invention to provide apparatus and method as above of manner of use which is particularly compatible with the opening and display of gifts as normally undertaken by gift recipients at large celebratory gatherings.

It is a still further object of my invention to provide apparatus as above which require the use of only relatively inexpensive, readily available materials of proven suitability to the task, and long-established manufacturing techniques of proven applicability to the task, in the fabrication of the same.

SUMMARY OF THE INVENTION

As disclosed herein, the apparatus and method of my invention comprise means for use in conjunction with a gift card for the positive and convenient correlation by the recipient of a gift of the identity of the donor of the gift with the gift. The donor identity - gift correlation means are attached in readily detachable manner to the gift card by re-usable attachment means.

The gift card preferably is a greeting cad which bears indicia associated with a gift-giving occasion.

In one representatively disclosed form of the invention, the donor identity - gift correltation means comprise a donor identification label upon which the donor of the gift records his or her identity, location and contact information, for example, name, address, telephone number and FAX address, prior to the presentation of the gift with the gift card. Upon opening of the gift and the gift card, the recipient removes the donor identification label from the gift card and attaches the same through use of the re-usable attachment means to the gift, thereby providing positive correlation between the identity of the gift donor and the gift, and all information necessary to the transmission of an appropriate message of acknowledgement and thanks in accordance with prevailing social obligations to that effect. In addition, the presence of the donor identification label on the gift serves as a virtually fool-proof reminder to the gift recipient of that social obligation.

In another representatively disclosed form of the invention, the donor identification label and the gift card are configured or otherwise arranged to present essentially the same appearance, which is preferably somewhat distinctive; and no donor identification information need be recorded by the gift donor on the donor identification label. In use, the gift donor simply annotates, as may be desired, and signs the gift card in normal manner outside of the boundaries of the donor identification label, and presents the same with the gift. Upon receipt and inspection of the gift, the gift recipient again removes the donor identification label from the gift card and attaches the same as heretofore described to the gift; whereby subsequent correlation between the essentially like appearances of the donor identification label on the gift and the retained, signed gift card, functions to positively identify the gift donor to the gift recipient for purposes of appropriate message of gift acknowledgement and thanks. Again, the presence of the donor identification label on the gift serves as a virtually fool-proof reminder to the gift recipient of the social obligation regarding a message of appreciation.

In all instances, confusion on the part of a recipient between gifts and the respective identities of the donors thereof, with resultant possibilities of acute embarassment, and or business disadvantage in instance wherein the gifts are "business" gifts, to the recipient attendant transmissions of gift acknowledgement and thanks to the wrong gift donors, are conveniently and positively prevented by the apparatus and method of my invention as disclosed herein.

DESCRIPTION OF THE DRAWINGS

The above and other objects and significant advantages of the apparatus and method of my invention are believed made clear by the following detailed description thereof taken in conjunction with the accompanying drawings whererin:

FIG. 3 is a perspective view of a representative gift with the gift donor identity-gift correlation means of FIGS. 1 and 2 operatively attached thereto;

FIG. 4 is a perspective view of a gift card and gift donor identity-gift correlation means representatively configured and operable in accordance with the teachings of another embodiment of the apparatus and method of my invention.

DETAILED DESCRIPTION OF THE INVENTION

Figure 1:
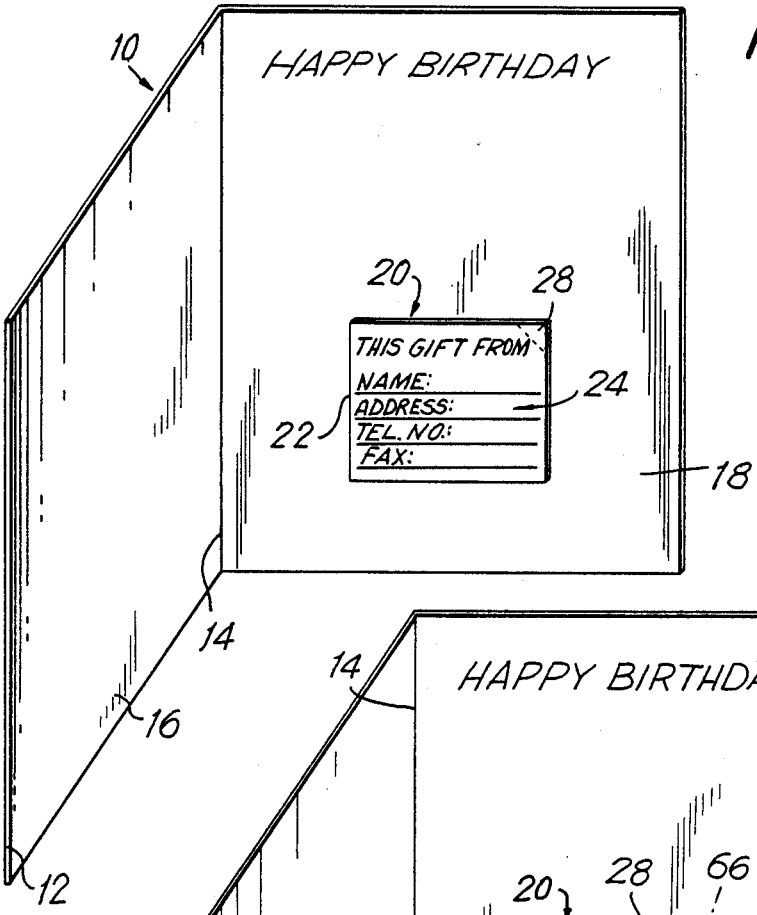
FIGS. 1 and 2 are respectively perspective views of a gift card including means representatively configured and operable in accordance with the teachings of the apparatus and method of my invention for the positive and convenient correlation of the identity of the donor of a gift with the gift; with FIG. 1 depicting those correlation means prior to the utilization thereof, and FIG. 2 depicting the same intermediate the removal thereof from the gift card.
Figure 2:
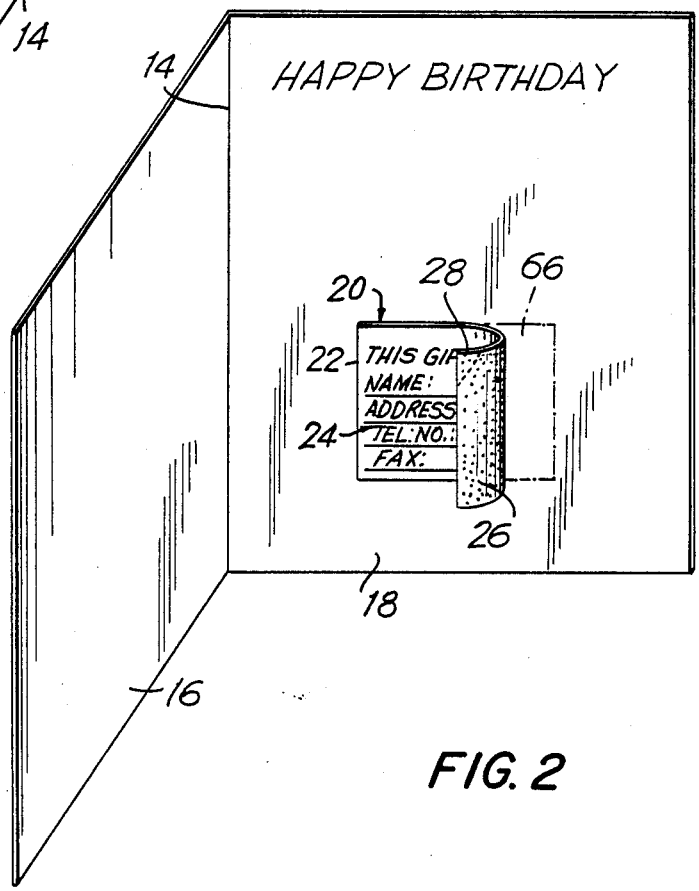

Referring now to FIGS. 1 and 2 of the application drawings, a gift card of conventional configuration is indicated generally at 10; and is formed by a sheet 12 of suitably finished heavy paper card stock or the like which is folded shown along a fold line 14 to provide mating gift card pages 16 and 18 which are readily manipulatable from a folded or "closed" gift card condition (not shown) to the generally unfolded or "open" gift card condition as illustrated in drawing FIGS. 1 and 2.

New and improved means representatively configured and operable in accordance with the currently contemplated best mode of the teachings of the apparatus and method of my invention for the positive and convenient correlation by the recipient of a gift of the identity of the donor of the gift with the gift are indicated generally at 20 in FIGS. 1 and 2 of the application drawings; and take the form of a donor identification label 22 also formed, for example, from suitably finished heavy paper card stock or the like. The donor identification label 22 comprises the legend "THIS GIFT FROM" or similar words to that effect, printed thereon as shown adjacent the upper label edge; and a suitably lined gift donor identification area 24 appearing therebelow and including the legends "NAME," "ADDRESS," "TEL. NO." and "FAX" printed thereon as shown for recording the indicated information.

Donor identification label 22 is affixed to the gift card 10 in readily detachable and re-usable manner by the gift card manufacturer through use of any suitable, re-usable attachment means, for example, a common, non-drying adhesive which is applied to the back surface of the donor identification label 22 as indicated at 26 in FIG. 2; and the donor identification label 22 is in turn detachably affixed to the gift card 10 at any location deemed appropriate, for example, the lower portion of the inner face of gift card page 18 as shown in FIGS. 1 and 2 by the simple application of the label to the gift card page surface and the pressing of the label into firm surface contact therewith to attach the same thereto.

The donor identification label 22 preferably includes an upper corner portion 28 as delineated by the dashed lines in FIGS. 1 and 2 of the application drawings, and to the back surface of which no adhesive 26 is applied; and this provides a readily and conveniently graspable tab or the like for the removal of the label 22 from the gift card page 18 for described in detail hereinbelow.

In representative use of the gift donor identity-gift correlation means 20 in conjunction with the donation of a packaged and wrapped gift, the gift donor simply opens the gift card 10, completes the identification information as heretofore described by writing the same in the lined donor identification label area 24 in accordance with the legends appearing thereon, closes the gift card 10 and places the same in the gift card envelope, assuming the same to have been provided; and simply affixes the thusly "completed" gift card 10, either within the provided envelope or directly, as the case may be to the wrapping of the gift package in conventional manner, for example, through use of a suitable transparent tape or the like. Of course, the donor of the gift is in no way limited in the completion of the gift card 10 to the provision of the specified identification information on the donor identification label 22; but rather, remains free to place whatever additional writing as may be deemed appropriate on the respective surfaces 16 and 18 of the gift card 10.

Upon receipt of the gift with the gift card 10 completed and attached thereto as heretofore described the recipient opens the gift package wrapping, and gift package, and opens the gift card 10, not necessarily in that order, removes the donor identification label 22 from the gift card by grasping the tab 28 with the fingers to pull the label away from the gift card surface against the action of the adhesive 26 as illustrated in part in FIG. 2 of the application drawings, and immediately attaches the donor identification label to the gift, for example the family photograph album as representatively illustrated at 30 in FIG. 3 of the application drawings, by the simple and convenient application of the label to a readily accessible surface of the gift, and the pressing of the same thereonto to cause the re-usable adhesive 26 to form the desired attachment.

With the gift donor identity-gift correlation means 20 of my invention configured and utlilized as described, it will be immediately clear to those skilled in this art that the invention not only provides positive correlation between the identity of the gift donor and the gift to the gift recipient, but also provides to the latter all information necessary to the transmittal of an appropriate message of thanks to the gift donor in any desired one of a variety of manners, namely, by telephone call, by written "thank you" note transmitted through the mails, of by FAXed message of the same. This can prove particularly useful to the gift recipient in those instances wherein the current address, telephone number, and/or FAX address, if any, of the gift donor are not otherwise known to the gift recipient, for example in instances wherein the donor is someone from a distant location and with whom the recipient has been out of touch for a long period of time, or is someone in the military subject to frequent changes of location and address. Thus, the gift donor identity -gift correlation means 20 of my invention perform a plurality of particularly useful functions to gift recipients, and especially on occasions, for example, such as a large surprise 50th Birthday Party at which large numbers of gifts are received in a very short period of time by the Birthday celebrant, and it becomes very easy due to the intense excitement, good cheer and extreme animation of the moment to confuse the gifts with the gift donors with resultant very real possibility of truly acute embarrasment; for example a "thank you" message to a gift donor including the sentiment "thank you very much for the truly lovely vase" when, in fact, the gift from that particular donor was the family photograph album as representatively depicted in FIG. 3 of the application drawings, and which was chosen by the donor only after very careful and extended deliberation on the basis that the same would be "just right" for the occasion in question. On such occasions whereat the gifts are normally opened by the recipient in the presence of the assembled guests as an integral part of the festivities, attachment as heretoforedescribed of the donor identification label 22 to the gift by the gift recipient is rendered particularly convenient and appropriate by the fact that the gifts are, in any event, normally handled and displayed by the recipient to the group as part of that ritual; and it will be clear that a certain element of humor and good cheer can be introduced by the recipient to the identification label attachment process by such remarks as "This one absolutely has to be identified for posterity," or "I am marking this in evidence as Plaintiff's Exhibit A."

Other celebratory occasions at which the gift donor identity-gift correlation means 20 of my invention would find particularly useful application include, but are not limited to, large bridal showers, weddings, retirement parties, housewarming parties, high school or college graduation parties, communion or confirmation parties, bar or bas mitzvah parties, and christenings.

In addition to the above, the gift donor identity-gift correlation means 20 of my invention can perform a further particularly useful function to the gift recipient by serving as a reminder to that recipient of the social obligation to acknowledge the gift with an appropriate message of thanks; with the very visible presence of the donor identification label 22 on the gift serving as a virtually foolproof reminder of that social obligation to the gift recipient upon subsequent inspection and/or use of the gift. Once the gift has been properly acknowledged, the identification label 22 may of course be readily and conveniently removed form the gift, without adverse effect thereon, by simply peeling the same therefrom as described for label removal from the gift card 10, and simply discarded, thus insuring that the label in no way interferes with or detracts from the enjoyment of the gift by the recipient thereof.

In accordance with the above, it will also be immediately clear to those skilled in this art that the gift donor identity-gift correlation means 20 of my invention render totally unnecessary the retention of the gift card 10 by the gift recipient, unless of course desired for sentimental reasons; and, in any event, render totally unnecessary determined attempts on the part of the gifts recipient in instances wherein large numbers of gifts are received in a relatively short period of time to securely correlate the gift cards with the gifts presented therewith; which determined attempts very often fail in the excitement, spontaneity and general disarray of the moment, and can detract markedly from that excitement and spontaneity.

Of course, use of the gift card 10 incorporating the gift donor identity-gift correlation means 20 of my invention as heretofore described is by no means limited to celebratory occasions, but rather, would also find particular applicability to purely "business" gifts as have now become commonplace and, in fact, under certain circumstances, virtually required at certain "business" functions; it being clear that confusion and mistake as to the identity of the donor of a gift under these circumstances could very well result in more serious consequences than "simple" acute embarassment, to wit, loss of client or account.

Referring now to FIG. 4, a gift card is indicated generally at 32; and, in the manner of gift card 10 of FIGS. 1 and 2, comprises a sheet 34 of suitably finished heavy paper card stock or the like which is folded along an interrupted fold-line 36 to provide mating gift card pages 38 and 40. The gift card 32 is preferably of distinctive appearance; which, as representatively depicted in FIG. 4, is provided by the multi-pointed star-like configurations of the mating gift card pages 38 and 40. Alternatively, this distinctive appearance of the gift card 32 may be provided by the use of distinctive colors or combinations thereof, or distinctive designs as printed on the gift card pages 38 and 40, or a variety of combinations of the above, namely, distinctive configuration(s), color(s) and/or design(s).

New and improved means representatively configured and operable in accordance with another embodiment of the currently contemplated best mode of the teachings of the apparatus and method of my invention for the positive and convenient correlation by the recipient of a gift of the identity of the donor of the gift with the gift are indicated generally at 42 in FIG. 4 of the application drawings; and again take the form of a donor identification label as there indicated at 44 also formed, for example, from suitably finished heavy paper card stock of the like.

In the manner heretofore described for donor identification label 22 of FIGS. 1 and 2, donor identification label 44 is affixed to the gift card 32 in readily detachable and re-usable manner by the gift card manufacturer through use of suitable, re-usable attachment means, again for example a common non-drying adhesive (not shown) which is applied to the back surface of the donor identification label 42; and the latter is in turn detachably affixed as shown to page 40 of the gift card 32 by the simple application thereof to the gift card page surface and the pressing of the label 42 into firm surface contact therewith to form the desired attachment.

Donor identification label 44 preferably includes an upper corner portion 46 as delineated by the dashed line in FIG. 4 of the application drawings, and to the back surface of which no adhesive is applied; thus forming a tab or the like for the ready and convenient removal of the label 44 from page 40 of the gift card 32 as heretofore described with regard to tab 28 of donor identification label 22 of FIGS. 1 and 2.

In accordance with the teachings of my invention, the appearance of donor identification label 44 is made to be essentially the same as the appearance of the gift card 32, to thus provide for virtually immediate visual correlation therebetween for purposes described in detail hereinbelow, although the label 44 is of course somewhat smaller than the gift card 32. More specifically, and as representatively depicted in FIG. 4, with the gift card 32 configured to present a distinctive, multi-pointed star-like appearance, donor identification label 44 is configured as shown to present essentially the same, or matching, multi-pointed star-like appearance, albeit on a somewhat smaller scale.

No legends or gift donor identification area or the like are provided on the donor identification label 44 and no writing of any nature need be made thereon by the gift donor.

In representative use of the gift donor identity-gift correlation means 42 in conjunction with the donation of a gift, the gift donor simply signs the gift card 32 of FIG. 4 in conventional manner, for example on gift card page 40, outside of the area of donor identification label 44, and then simply affixes the gift card 32, directly or within a provided envelope as the case may be, to a packaged gift as heretofore described for gift card 10 of FIGS. 1 and 2.

Upon receipt of the gift with the gift card 32 completed and attached thereto as described, the recepient opens the gift and the gift card 32, removes the donor identification label 44 from the gift card by grasping the tab 46 with the fingers to pull the label away from the gift card surface against the action of the adhesive, and immediately attaches the label 44 to the gift as heretofore described. In this instance, however it is necessary for the recipient of the gift to also retain the gift card 32 as signed by the donor of the gift; although that gift card need in no way be retained with or attached to or packaged with the gift. Subsequently, and when the time comes for the preparation of an appropriate message of acknowledgement and thanks for the gift, the recipient of the gift need only visually correlate the distinctive appearance of the donor identification label 44 on the gift with the like distinctive appearance of the signed gift card 32 to arrive at a positive identification of the donor of the gift. Thereafter, the donor identification label 44 can be simply peeled from the gift and discarded along with the gift card 32 unless retention of the latter for sentimental or other reasons is desired.

Although representatively disclosed as making use of the like distinctive configurations of the gift card 32 and the donor identification label 44 to provide the requisite correlation in appearance therebetween, it will be clear to those skilled in this art that, alternatively, this correlation in appearance can be provided by correlation between distinctive color(s), distinctive printed design(s), and/or by a variety of combinations thereof on both the gift card 32 and the donor identification label 44 as discussed hereinabove.

Figure 5:
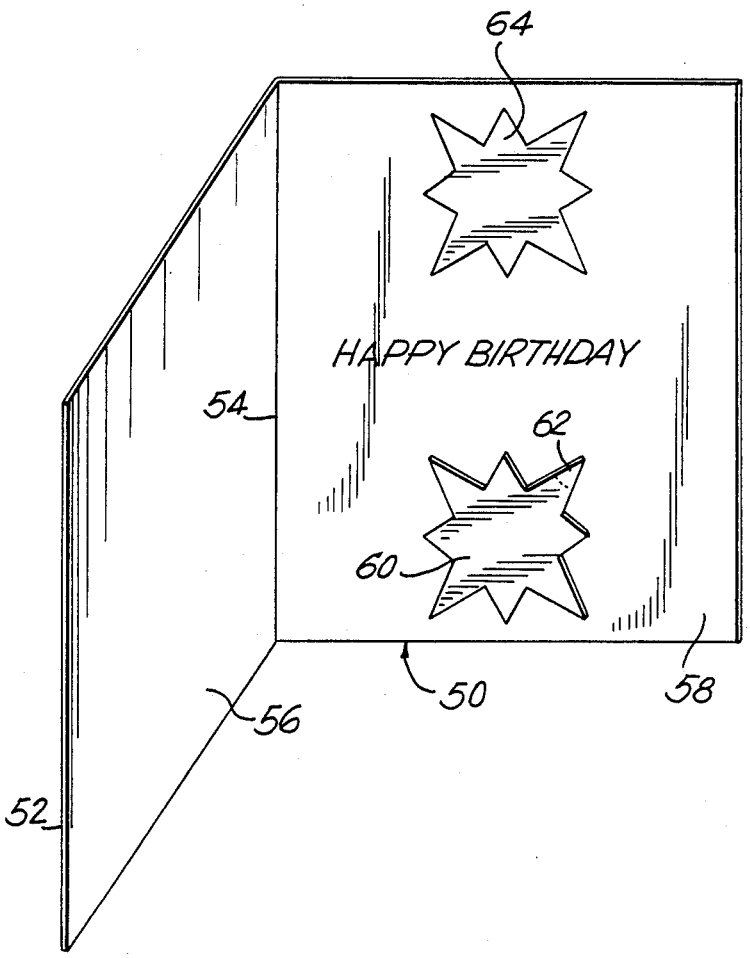
FIG. 5 is a perspective view of a gift card and gift donor identity-gift correlation means representatively configured and operable in accordance with the teachings of another embodiment of the apparatus and method of my invention.

As an alternative to correlation as depicted in FIG. 4 between the appearance of the donor identification label, and the appearance of the gift card as a whole, it is also contemplated within the scope of my invention that such correlation be made instead between the appearance of the donor identification label and a like design on the gift card. This is illustrated in FIG. 5 wherein a gift card is indicated generally at 50; and again in the manner of gift card 10 of FIG. 1 comprises a sheet 52 of suitably finished heavy paper card stock or the like which is folded as shown along a fold line 54 to provide mating gift card pages 56 and 58. The donor identification label is indicated at 60 in FIG. 5; and is of the same configuration and manner of attachment to the gift card 50 as described in detail hereinabove with regard to donor identification label 44 of FIG. 4 and again includes a tab as indicated at 62 for the ready peeling thereof from the gift card page 58 for attachment to the gift. In this instance, however, the gift card 50 is of conventional quadrangular configuration as shown; but a design as indicated at 64 of configuration identical to the unique configuration of the donor identification label 60 is formed thereon as shown.

Gift card 50 of FIG. 5 is used by the gift recipient in the same manner as that heretofore described in detail with regard to gift card 32 of FIG. 4; with positive correlation between the identity of the gift donor and the gift being provided in the case of gift card 50 by visual correlation of the respective like unique appearances of the donor identification label 60 and the design 64 on the gift card, rather than of the donor identification label and the gift card itself.

Although not shown as such, it will be clear to those skilled in this art that the surface of the gift card page area to which the donor identification label is removably attached as heretofore described by the non-drying adhesive—for example the surface area of gift card page 18 as delineated in part by phantom lines and indicated at 66 in FIG. 2—may, if required by the physical characteristics thereof vis-a-vis those of the non-drying adhesive, be suitably treated in any appropriate manner, for example by the waxing or plasticizing thereof or the like, to prevent the donor identification label from too strongly adhering thereto and bonding therewith with resultant actual removal of portions of the gift card page from that surface area along with the donor identification label when the latter is peeled therefrom as described; it being clear that such could possibly result in less than perfect attachment in turn of the donor identification label to the gift as heretofore described. Alternatively, prevention as described of overly strong bonding of the donor identification label to the gift card page may be accomplished by the interposition therebetween of a separate piece of material having the desired surface characteristics on the outer surface thereof, and the attachment of the donor identification label thereto through use of the non-drying adhesive; and this technique is now well known in the art and found, for example, in mailers such as those circulated by Playboy, Inc. of Chicago, Ill. wherein one removes a gold sticker from such material and re-attaches it through use of the non-drying adhesive in either of "YES" or "NO" boxes on another portion of the mailer.

Although non-drying, re-usable adhesives of the type heretofore described for use on the back of the donor identification label are now applicable to a very wide variety of articles of manufacture without adverse effect thereon, for example even directly to articles of clothing as evidenced by the current proliferation of name tages bearing the legend "Hello, My Name Is _____" as now widely distributed at social and/or business functions and which are applied directly to one's clothing for subsequent removal therefrom without adverse effect at the end of the function, it is nonetheless clearly understood that for certain gifts, for example particularly delicate lingerie or fine natural fur garments or the like, attachment as described of the donor identification label directly to the gift might simply not prove desirable; in which instance attachment as described of the label to the gift packaging rather than directly to the gift is contemplated within the scope of my invention.

Various changes may of course be made in my invention as representatively disclosed herein without departing from the spirit and scope thereof as defined in the appended claims.

What is claimed is:

1. A greeting card for use in conjunction with the donation of a gift by a donor to a recipient, said greeting card bearing indicia associated with a gift-giving occasion, donor identification means for identifying the donor of the gift, and re-usable means operatively associated with said donor identification means for attaching the same to said greeting card n readily detachable manner whereby, said donor identification means may be readily detached from said greeting card by a recipient of said gift upon receipt of the gift and attached to the gift through use of said re-usable attachment means to positively correlate the identification of the gift donor with the gift.

2. A greeting card as in claim 1, said donor identification means comprising a label with an adhesive usable to releasably adhere said label to said card and said gift.

3. Card as in claim 1, in which said label bears indicia facilitating the recording of the identification of the gift donor thereon.

4. A gift card for use in conjunction with the donation of a gift by a donor to a recipient, the improvements comprising, donor identification means for identifying the donor of the gift, and re-usable means operatively associated with said donor identification means for attaching the same to said gift card in readily detachable manner whereby, said donor identification means may readily detached from the gift card by a recipient of the gift upon receipt of the gift and attached to the gift through use of said re-usable attachment means to positively correlate the identification of the gift donor with the gift, said donor identification means comprising a label with an adhesive usable to releasably adhere said label to said card and the gift, said gift card and said label having essentially the same appearance whereby, the appearance of said label subsequent to the detachment thereof from said gift card and attachment to the gift may be correlated with the appearance of said gift card to provide identification of the donor of the gift.

5. A gift card for use in conjunction with the donation of a gift by a donor to a recipient, the improvements comprising, donor identification means for identifying the donor of the gift, and re-usable means operatively associated with said donor identification means for attaching the same to said gift card in readily detachable manner whereby, said donor identification means may readily detached from said gift card by a recipient of the gift upon receipt of the gift and attached to the gift through use of said re-usable attachment means to positively correlate the identification of the gift donor with the gift, said donor identification means comprising a label with an adhesive usable to releasably adhere said label to said card and the gift, said gift card having a design thereon which is of essentially the same appearance as said label whereby, the appearance of said label subsequent to the detachment thereof from said gift card and attachment to the gift may be correlated with the appearance of said design on said gift card to provide identification of the donor of the gift.

6. A method for use in conjunction with the donation of a gift by a donor to a gift recipient through use of a greeting card, the steps of, providing a greeting card bearing indicia associated with a gift-giving occasion, providing donor identification means attached to said card for identifying the donor of the gift, said donor identification means being attached to said greeting card in readily detachable manner through use of re-usable attachment means, and detaching said donor identification means from said greeting card and attaching the same to the gift through use of said re-usable attachment means subsequent to the receipt of the gift, thereby providing positive correlation between the identity of the donor of the gift and the gift.

7. A method as in claim 6 including the step of recording the identification of the donor of the gift on said donor identification means prior to the detachment thereof from said greeting card.

8. In a method for use in conjunction with the donation of a gift by a donor to a gift recipient through use of a gift card, the improvements comprising, the steps of, providing donor identification means for identifying the donor of the gift, attaching said donor identification means to said gift card in readily detachable manner through use of re-usable attachment means, and detaching said donor identification means from said gift card and attaching the same to the gift through use of said re-usable attachment means subsequent to the receipt of the gift thereby providing positive correlation between the identity of the donor of the gift and the gift, and providing essentially the same appearance for said gift card and said donor identification means whereby, the appearance of the donor identification means subsequent to the detachment thereof from said gift card and attachment thereof to the gift may be correlated with the appearance of the gift card to provide identification of the donor of the gift.

9. In a method for use in conjunction with the donation of a gift by a donor to a gift recipient through use of a gift card, the improvements comprising, the steps of, providing donor identification means for identifying the donor of the gift, attaching said donor identification means to said gift cad in readily detachable manner through use of re-usable attachment means, and detaching said donor identification means from said gift card and attaching the same to the gift through use of said re-usable attachment means subsequent to the receipt of the gift thereby providing positive correlation between the identity of the donor of the gift and the gift and providing a design of essentially the same appearance as said donor identification means on said gift card whereby, the appearance of the donor identification means subsequent to the detachment thereof from said gift card and attachment thereof to the gift may be correlated with the appearance of said design on the gift card to provide identification of the donor of the gift.

10. A method of identifying the donor of the gift, said method comprising the steps of:

(a) providing a card bearing greetings for a gift-giving occasion and having an identification tag removably attached thereto, said tag bearing indicia indicating the identity of the donor of the gift and having means for easily attaching it to said gift when removed from said card;

(b) associating said gift card with a gift to be given to a recipient; and (c) causing said gift and said card to be delivered to said recipient in association with one another so that said recipient can remove said tag from said card and attach it to said gift to identify its donor.

11. A method as in claim 10, in which said tag is adhered to said card with adhesive means allowing said tag to be removed from said card and adhesively attached to said gift.

12. A method as in claim 10, in which said indicia are selected from the group consisting of: written identification of said donor; and indicia appearing both on said card and on said tag.

13. A method as in claim 10, including a step in which said recipient removes said tag from said card and attaches it to said gift.

14. A greeting card for gift giving, said greeting card comprising a body member, said body member bearing first indicia associated with a gift-giving occasion a tag, attachment means on said tag, said tag being removably attached by said attachment means to said body member, said tag bearing second indicia for identifying the donor of said gift, said tag attachment means being adapted for attaching said tag to said gift when it is removed from said card, whereby the donor of said gift is positively identifiable with the gift.

15. A greeting card as in claim 14, in which said attachment means comprises an adhesive coating which allows said tag to be removed from said body member without damaging said body member, and which is unable to adhere the tag to said gift.

16. A greeting card as in claim 14, in which said second indicia is selected from the group consisting of means for providing written identification of the donor and indicia repeated on said body member.

* * * * *